US010822919B2

(12) United States Patent
Burris

(10) Patent No.: US 10,822,919 B2
(45) Date of Patent: Nov. 3, 2020

(54) DOWNHOLE COMPONENT INCLUDING A PISTON HAVING A FRANGIBLE ELEMENT

(71) Applicant: John Burris, Bixby, OK (US)

(72) Inventor: John Burris, Bixby, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 311 days.

(21) Appl. No.: 15/953,584

(22) Filed: Apr. 16, 2018

(65) Prior Publication Data

US 2019/0316439 A1 Oct. 17, 2019

(51) Int. Cl.
*E21B 34/06* (2006.01)
*E21B 34/14* (2006.01)

(52) U.S. Cl.
CPC ..... *E21B 34/063* (2013.01); *E21B 34/14* (2013.01); *E21B 2200/05* (2020.05)

(58) Field of Classification Search
CPC .. E21B 34/142; E21B 34/063; E21B 2200/05; E21B 34/14
See application file for complete search history.

(56) References Cited

U.S. PATENT DOCUMENTS 4,796,705 A * 1/1989 Carmody ..... E21B 34/102 166/323
5,207,272 A * 5/1993 Pringle ..... E21B 34/066 166/66.6
5,558,153 A 9/1996 Holcombe et al.
5,911,277 A 6/1999 Hromas et al.
10,605,047 B2 * 3/2020 Patel ..... E21B 34/10
2008/0110611 A1 * 5/2008 Bane ..... E21B 34/10 166/53
2008/0314599 A1 * 12/2008 Bane ..... E21B 23/04 166/375
2010/0200220 A1 * 8/2010 Beall ..... E21B 34/101 166/206
2010/0288557 A1 11/2010 Radford
2012/0024537 A1 * 2/2012 McDowell ..... E21B 34/102 166/373
2012/0304853 A1 * 12/2012 Burris ..... E21B 34/14 92/172

(Continued)

FOREIGN PATENT DOCUMENTS

WO 2017087504 A1 5/2017

OTHER PUBLICATIONS

International Search Report and Written Opinion for International Application No. PCT/US2019/021337; International Filing Date Mar. 8, 2019; Report dated Jun. 21, 2019 (pp. 1-10).

*Primary Examiner* — Shane Bomar
(74) *Attorney, Agent, or Firm* — Cantor Colburn LLP

(57) ABSTRACT

A downhole component has a body including a first end portion, a second end portion and an intermediate portion extending therebetween. The intermediate portion includes an outer surface and an inner surface. The inner surface defines a flow path. An axial passage extends radially outwardly of the flow path between the outer surface and the inner surface. A piston is arranged in the axial passage. The piston includes a first end, a second end, an intermediate section extending therebetween and a frangible element arranged adjacent at least one of the first end, the second end, and along the intermediate portion.

16 Claims, 8 Drawing Sheets

(56) References Cited

U.S. PATENT DOCUMENTS

| | | | | |
|---|---|---|---|---|
| 2013/0233547 | A1* | 9/2013 | Twardowski | E21B 34/10 166/285 |
| 2013/0333873 | A1 | 12/2013 | Giroux et al. | |
| 2015/0211333 | A1* | 7/2015 | Vick, Jr. | E21B 34/066 166/375 |

* cited by examiner

DOWNHOLE COMPONENT INCLUDING A PISTON HAVING A FRANGIBLE ELEMENT

BACKGROUND

In the resource exploration and recovery pressure chambers are often used to actuate various components. Often times, a control pressure may be applied to, for example, a piston supported in the pressure chamber. The piston may be used to selectively activate, for example, a subsurface safety valve. Of course, the control pressure may be employed to activate other subsurface devices. In some cases, the piston may become stuck. In such cases, it may be desirable to establish an alternative flow path for the control pressure.

Currently, when a piston becomes stuck, a puncturing tool is landed downhole at the pressure chamber. The puncturing tool may be activated to radially outwardly extend a puncturing mechanism that creates an opening through an area of weakness in the pressure chamber at an inner surface of load and pressure retaining tubulars. The opening provides a pathway for the control pressure to flow. Creating the opening through the area of weakness generally requires an annular chamber or complicated methods to align with the weak area. Therefore, the art would appreciate a system for creating an opening through a pressure chamber without creating an area of weakness in the load and pressure retaining tubular or requiring a complicated alignment method.

SUMMARY

Disclosed is a downhole component having a body including a first end portion, a second end portion and an intermediate portion extending therebetween. The intermediate portion includes an outer surface and an inner surface. The inner surface defines a flow path. An axial passage extends radially outwardly of the flow path between the outer surface and the inner surface. A piston is arranged in the axial passage. The piston includes a first end, a second end, an intermediate section extending therebetween and a frangible element arranged adjacent at least one of the first end, the second end, and along the intermediate portion.

Also disclosed is a downhole system including a tubular having a tool mechanism including an actuator. A downhole component is mechanically connected to the tubular. The downhole component has a body including a first end portion, a second end portion and an intermediate portion extending therebetween. The intermediate portion includes an outer surface and an inner surface. The inner surface defines a flow path. An axial passage extends radially outwardly of the flow path between the outer surface and the inner surface. A piston is arranged in the axial passage. The piston includes a first end, a second end mechanically connected to the actuator, an intermediate section extending therebetween and a frangible element arranged adjacent at least one of the first end, the second end, and along the intermediate portion.

Further disclosed is a method of bypassing a piston in a downhole component including connecting a tool to a flow tube of a downhole component, breaking a frangible element on a piston operatively connected with the flow tube to expose a control fluid passage extending through the piston, and flowing a control fluid through the control fluid passage.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
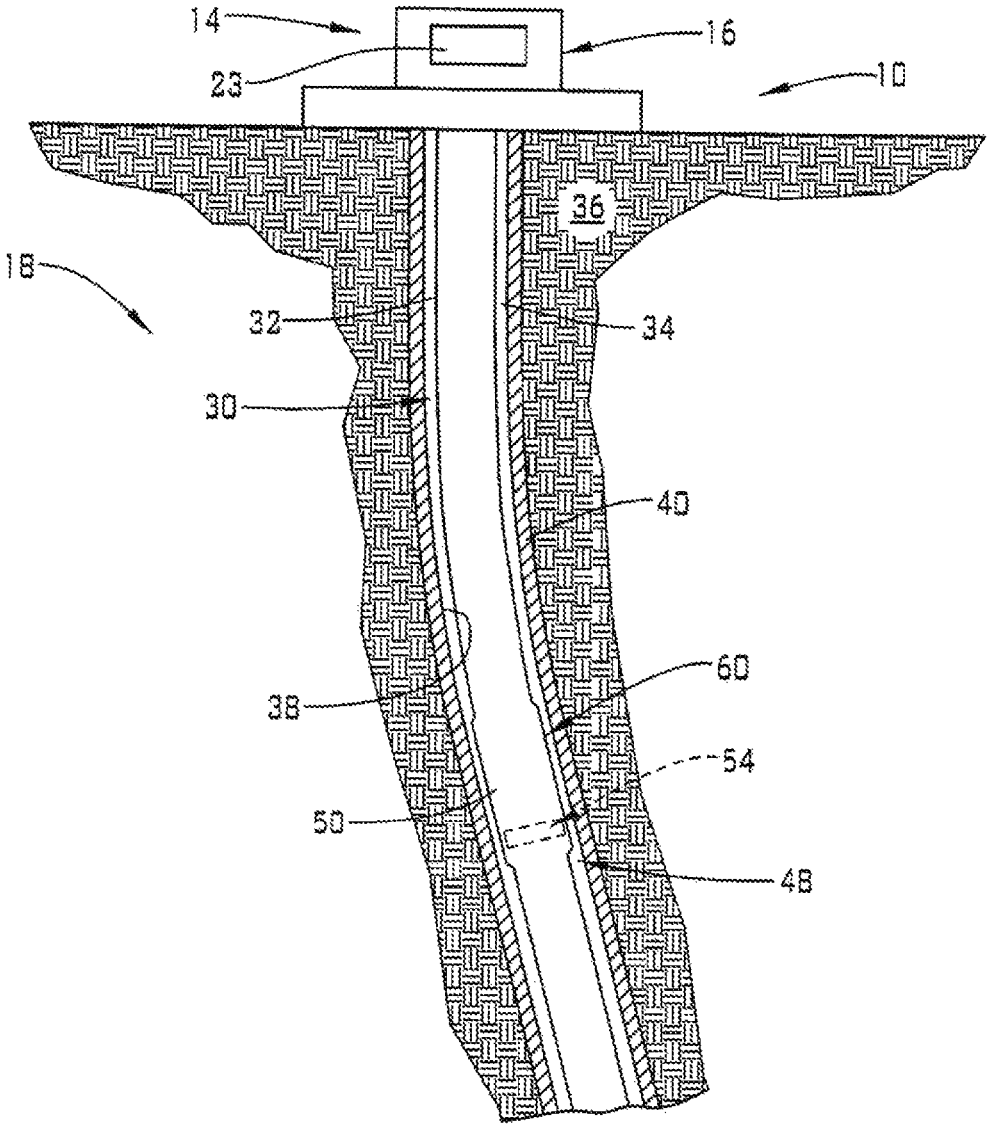
FIG. 1 depicts a resource exploration and recovery system including a downhole component having a piston including a frangible element, in accordance with an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein. Surface system 16 may include additional systems such as pumps, fluid storage systems, cranes and the like (not shown).

Second system 18 may include a tubular string 30, formed from one or more tubulars 32, which extends into a wellbore 34 formed in formation 36. Wellbore 34 includes an annular wall 38 which may be defined by a surface of formation 36, or a casing tubular 40 such as shown. In an exemplary aspect, tubular string 30 supports a downhole system 48 including a tubular 50 that houses a tool mechanism 54. A downhole component 60 may be coupled with tubular 50 for purposes of activating tool mechanism 54.

Figure 2:
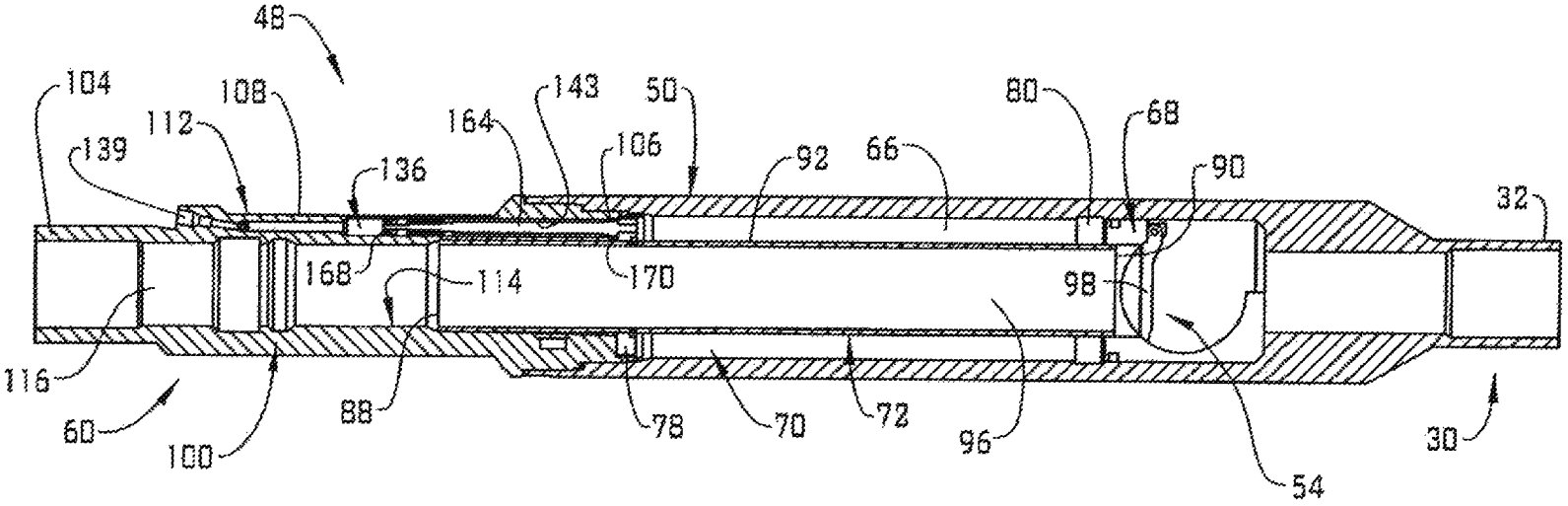
FIG. 2 depicts a downhole system including a tubular having a tool mechanism shown in a first position and a downhole component, in accordance with an exemplary aspect.
Figure 3:
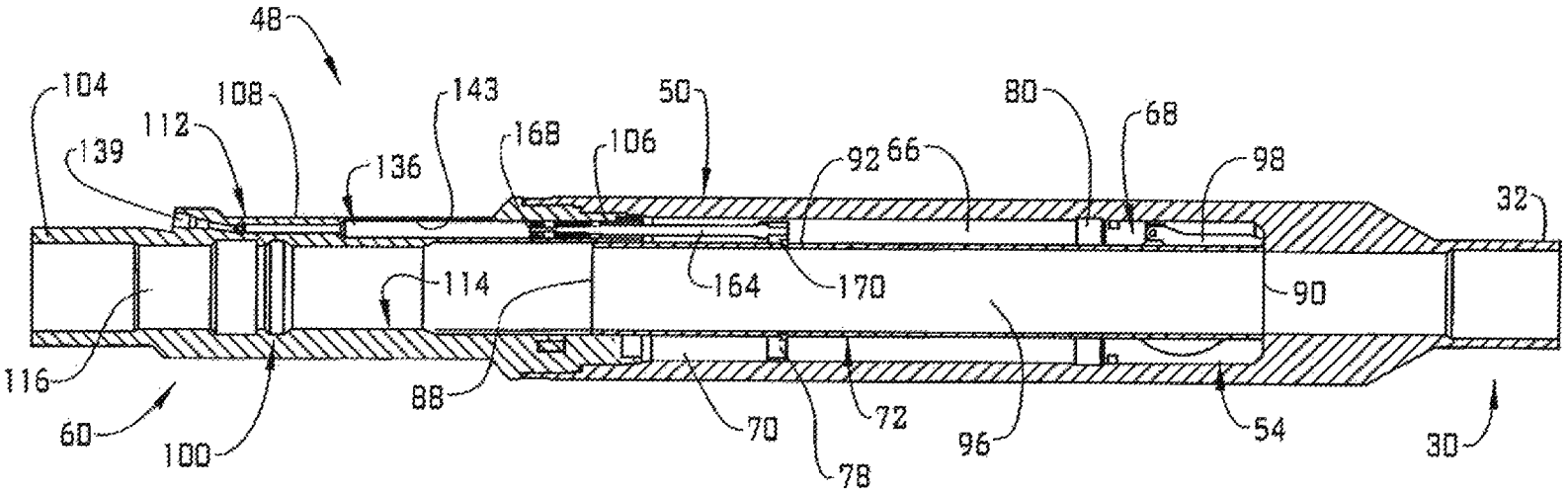
FIG. 3 depicts the downhole system including the tubular having the tool mechanism shown in a second position, in accordance with an exemplary aspect.

Referring to FIGS. 2 and 3, tubular 50 includes an inner passage 66 within which resides tool mechanism 54. In an embodiment, tool mechanism 54 is depicted as a subsurface safety valve (SSSV) 68. However, it should be understood that tool mechanism 54 may take on various forms. Tool mechanism 54 also includes an actuator 70 including a flow tube 72 supported within inner passage 66 by a first support collar 78 and a second support collar 80.

Flow tube 72 includes a first end 88, a second end 90 and an intermediate section 92 that defines a conduit 96. First support collar 78 may be arranged at intermediate section 92 and second support collar 80 may be arranged at second end 90. First support collar 78 may be connected to downhole component 60 to axially shift flow tube 72 along inner passage 66. First support collar 78 may be a separate component or may be integrally manufactured with flow tube 72. As will be detailed more fully herein, downhole component 60 shifts flow tube 72 toward a flapper 98 to open SSSV 68.

Downhole component 60 includes a body 100. Body includes a first end portion 104, a second end portion 106 and an intermediate portion 108 extending therebetween. Body 100 also includes an outer surface 112 and an inner surface 114 that defines a flow path 116 that registers with conduit 96.

An axial passage 136 extends through body 100. Axial passage 136 includes a first end 139 exposed at outer surface 112, a second end (not separately labeled) that is exposed at second end portion 106 and an intermediate portion 143. A piston 164 is arranged in axial passage 136 and is positioned such that is it can interact with the first support collar 78. Piston 164 may be acted upon by, for example, a control, fluid that applies hydraulic pressure to shift flow tube 72 through and/or into valve member 84 to open SSV 68.

Figure 4:
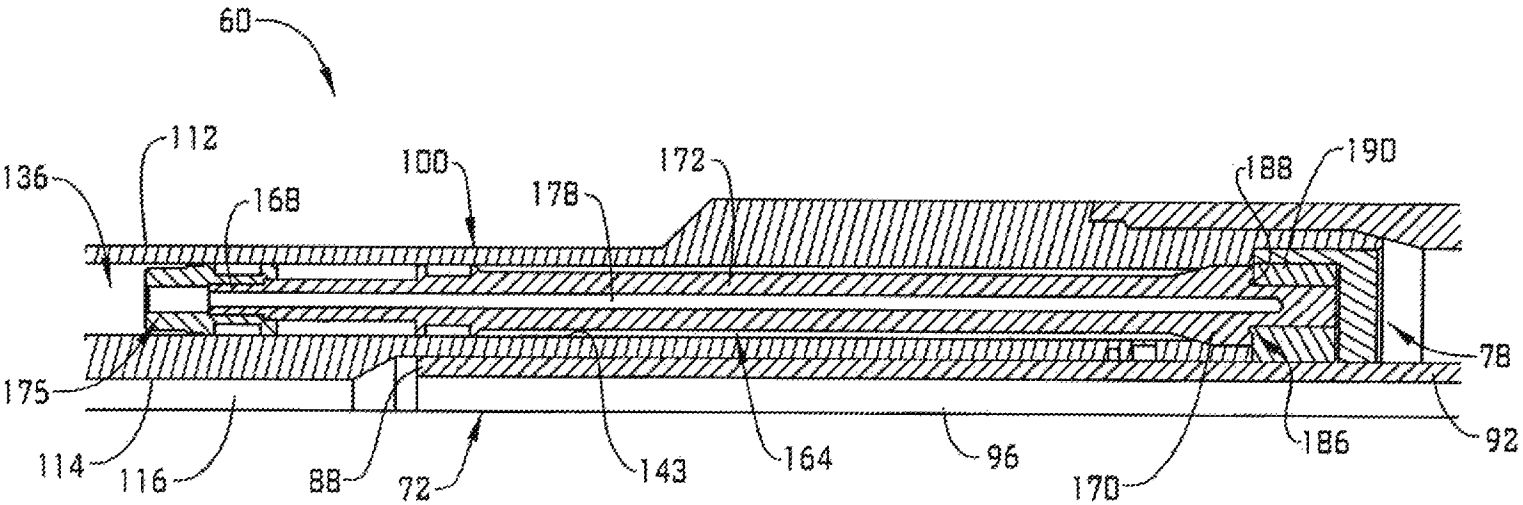
FIG. 4 depicts a cross-sectional partial side view of the downhole component illustrating the piston having the frangible element prior to separation by shearing. in accordance with an aspect of an exemplary embodiment.
Figure 5:
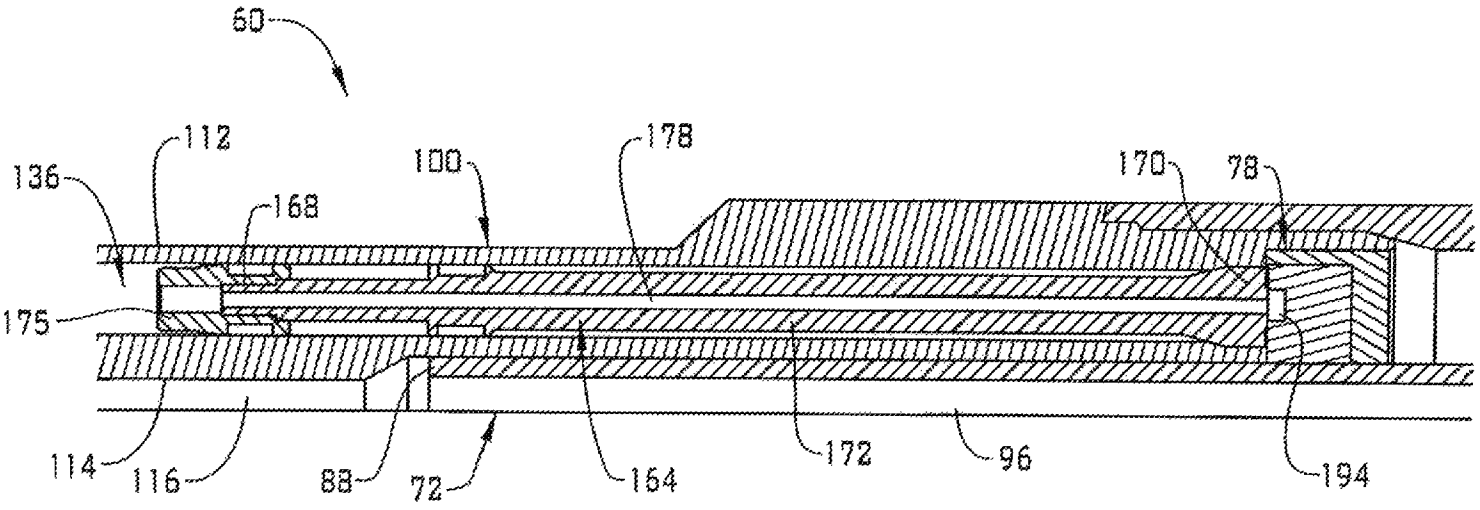
FIG. 5 depicts the cross-sectional partial side view of the downhole component of FIG. 4 illustrating the piston after separation by shearing. in accordance with an aspect of an exemplary embodiment.

In accordance with an exemplary aspect illustrated in FIG. 4, piston 164 includes a first end portion 168, a second end portion 170 and an intermediate section 172 extending therebetween. A retainer nut 175 may be provided at first end portion 168. Piston 164 includes a control fluid passage 178 that extends from first end portion 168 through second end portion 170. Control fluid passage 178 provides a bypass routing for control fluid passed to piston 164 in the event of an activation or deactivation failure.

In further accordance with an exemplary aspect, piston 164 includes a cap member 184 connected to second end portion 170 through a frangible element 186. Frangible element 186 defines an area of weakness 188 forming a joint between second end portion 170 and cap member 184. Area of weakness 188 defines a zone in which cap member 184 is more likely than not to separate from piston 164 when subjected to a selected force.

In still further accordance with an exemplary embodiment, cap member 184 is supported by an insert 190 arranged in first support collar 78. Insert 190 includes a groove 194 that allow control fluid to bypass piston 164 after cap member 184 is separated from second end portion 170. As an example, groove 194 may be fluidically connected with passage 66. In an embodiment, cap member 184 is configured to be separated from second end portion 170 opening control fluid passage 178 when exposed to a shear force. The shear force may be developed by initiating a rotation of flow tube 72. Rotation of flow tube 72 may be translated to cap member 184 through first support collar 78. Flow tube 72 may be rotated by various downhole tools that may engaged with, for example, first end 88.

Figure 6:
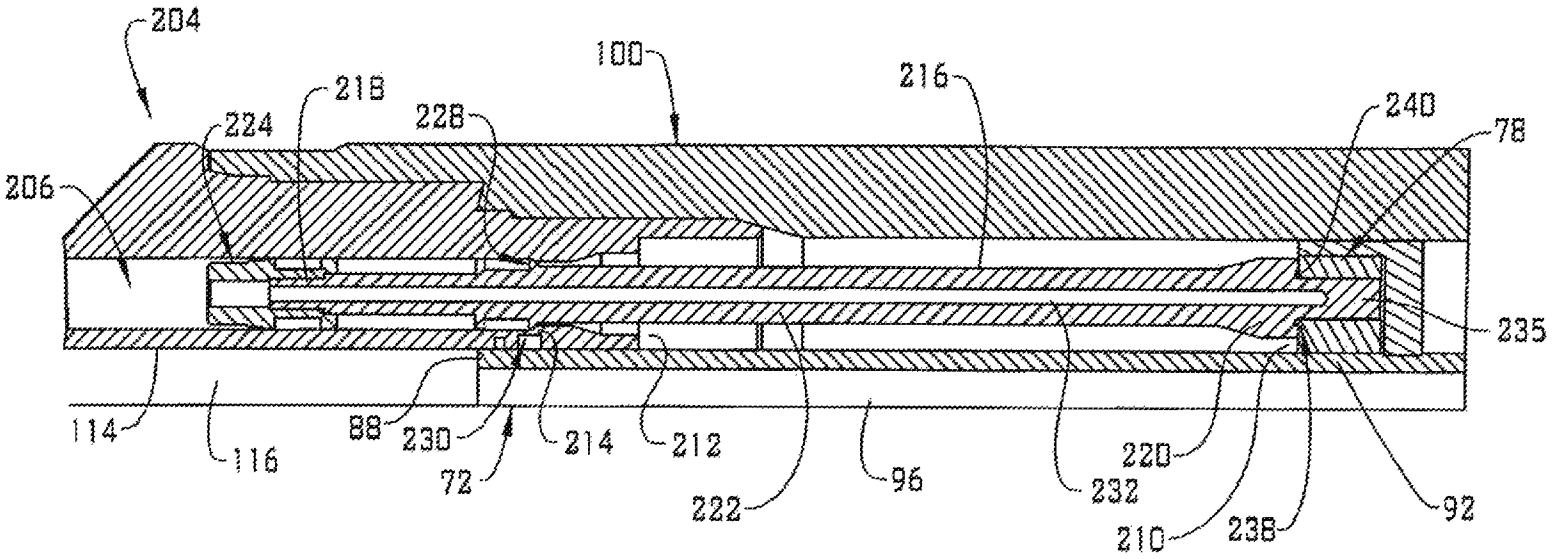
FIG. 6 depicts a cross-sectional partial side view of the downhole component illustrating the piston having the frangible element prior to separation through application of a tensile force. in accordance with an aspect of an exemplary embodiment
Figure 7:
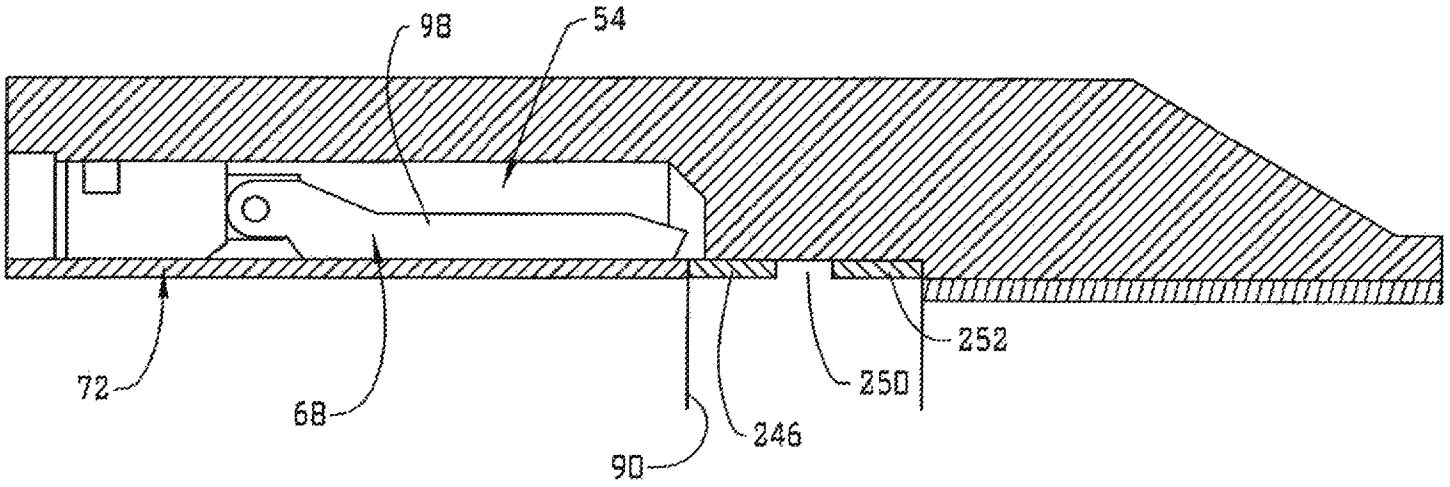
FIG. 7 depicts a cross-sectional partial side view of an axial end of the tool mechanism prior to separation of the frangible element of FIG. 6.
Figure 8:
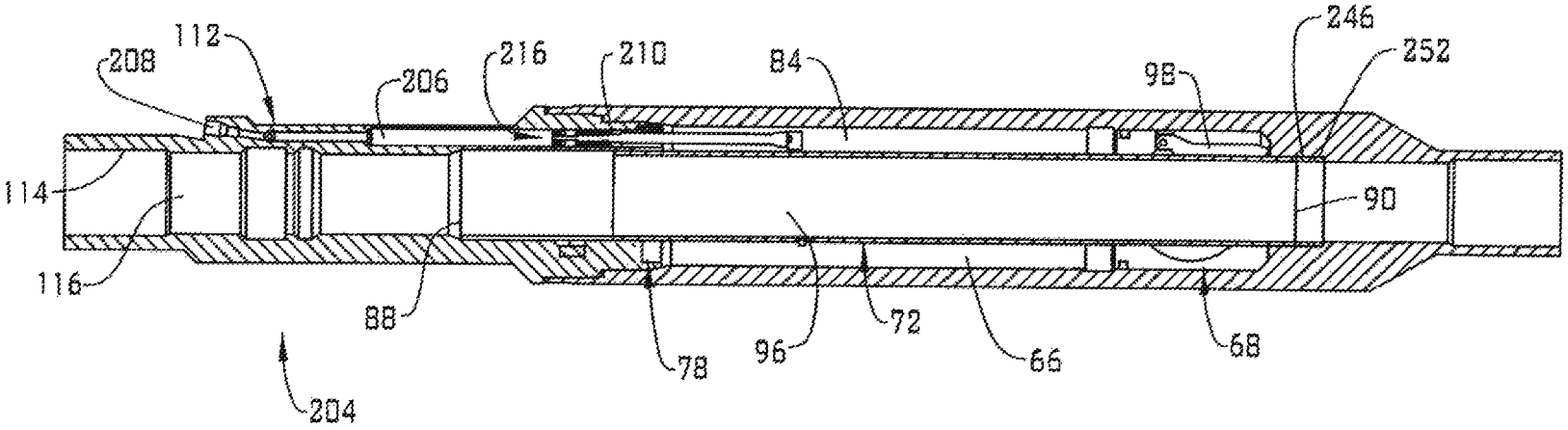
FIG. 8 depicts the cross-sectional partial side view of then axial end of the tool mechanism of FIG. 7 after separation of the frangible element of FIG. 6.

Reference will now follow to FIGS. 6-8, wherein like reference numbers represent corresponding parts in the respective views, in describing a downhole component 204 in accordance with another aspect of an exemplary embodiment. Downhole component 204 includes an axial passage 206 having a first end 208 (FIG. 8), a second end 210, and an intermediate portion 212 extending therebetween. A shoulder 214 projects radially inwardly from intermediate portion 212.

In the exemplary embodiment shown, a piston 216 is arranged in axial passage 206. Piston 216 includes a first end portion 218, a second end portion 220, and an intermediate portion section 222. A retainer nut 224 may be arranged at first end portion 218. An annular projection 228 may be formed on intermediate section 222. Annular projection 228 serves as a travel limiter 230 for piston 216. That is, annular projection 228 may engage with shoulder 214 to limit travel of piston 216 within axial passage 206.

In accordance with an exemplary aspect, piston 216 includes a control fluid passage 232 that extends from first end portion 218 through second end portion 220. A cap member 235 is secured to second end portion 220 through a frangible element 238. Frangible element 238 defines an area of weakness 240 forming a joint between second end portion 220 and cap member 235. Area of weakness 240 defines a zone in which cap member 235 is more likely than not to separate from piston 216 when subjected to a selected force.

In still further accordance with an exemplary embodiment, cap member 235 is supported by first support collar 78. Groove 194 formed in insert 190 allows control fluid to bypass piston 164 after cap member 235 is separated from second end portion 220. As an example, the groove may be fluidically connected with passage 66.

In an embodiment, cap member 235 is configured to be separated from second end portion 220 when exposed to a tensile force. The tensile force may be developed by initiating axial movement of flow tube 72 deeper into SSSV 68. For example, as shown in FIG. 7, a shear element 246 may be arranged in tubular 50 at SSSV 68. Shear element 246 may serve as a travel stop for flow tube 72. In the event piston 216 becomes stuck in axial passage 206, an additional force may be applied to flow tube 72 causing shear element 246 to dislodge and travel across distance defined by a gap 250. Another stop member 252 may be arranged at a downward end of gap 250. The additional travel of flow tube 72 causes cap member 235 to separate from second end portion 220 opening control fluid passage 232 allowing control fluid to flow through control fluid passage 232 thereby bypassing piston 216.

In accordance with yet another aspect of an exemplary embodiment, cap member 235, for example, may be separated from second end portion 220 as a result of fluid pressure. More specifically, fluid may be introduced into control fluid passage 232 at a pressure sufficient to cause cap member 235 to separate from piston 216. Once separated, fluid may pass through control fluid passage 232 and bypass piston 216.

Set forth below are some embodiments of the foregoing disclosure:

Embodiment 1: A downhole component including a body including a first end portion, a second end portion and an intermediate portion extending therebetween, the intermediate portion including an outer surface and an inner surface, the inner surface defining a flow path; an axial passage extending radially outwardly of the flow path between the outer surface and the inner surface; and a piston arranged in the axial passage, the piston including a first end, a second end, an intermediate section extending therebetween and a frangible element arranged adjacent at least one of the first end, the second end, and along the intermediate portion.

Embodiment 2: The downhole component according to any prior embodiment wherein the piston includes a flow path extending from the first end toward the second end along the intermediate portion.

Embodiment 3: The downhole component according to any prior embodiment wherein the piston includes a cap member connected at the second end by the frangible element.

Embodiment 4: A downhole system including a tubular including a tool mechanism having an actuator; and a downhole component mechanically connected to the tubular, the downhole component including a body including a first end portion, a second end portion and an intermediate portion extending therebetween, the intermediate portion including an outer surface and an inner surface, the inner surface defining a flow path; an axial passage extending radially outwardly of the flow path between the outer surface and the inner surface; and a piston arranged in the axial passage, the piston including a first end, a second end mechanically connected to the actuator, an intermediate section extending therebetween and a frangible element arranged adjacent at least one of the first end, the second end, and along the intermediate portion.

Embodiment 5: The downhole system according to any prior embodiment wherein the piston includes a flow path extending from the first end toward the second end along the intermediate portion.

Embodiment 6: The downhole system according to any prior embodiment wherein the piston includes a cap member connected at the second end by the frangible element.

Embodiment 7: The downhole system according to any prior embodiment wherein the cap member is provided at to the actuator.

Embodiment 8: The downhole system according to any prior embodiment wherein the tool mechanism comprises a subsurface safety valve (SSSV).

Embodiment 9: The downhole system according to any prior embodiment wherein the actuator includes a flow tube that is selectively shiftable through the SSSV.

Embodiment 10: The downhole system according to any prior embodiment wherein the actuator includes a first support collar connected to the flow tube, and a second support collar connected to the flow tube, the piston being connected to one of the first and second support collars.

Embodiment 11: A method of bypassing a piston in a downhole component including connecting a tool to a flow tube of a downhole component; breaking a frangible element on a piston operatively connected with the flow tube to expose a control fluid passage extending through the piston; and flowing a control fluid through the control fluid passage.

Embodiment 12: The method of any prior embodiment wherein breaking the frangible element includes rotating the flow tube to exert a shear force on the frangible element.

Embodiment 13: The method of any prior embodiment wherein breaking the frangible element includes axially shifting the flow tube to exert a tensile force on the frangible element.

Embodiment 14: The method of any prior embodiment wherein axially shifting the flow tube includes shifting a shear member.

Embodiment 15: The method of any prior embodiment further comprising: limiting axial travel of the flow tube after shearing the shear member.

Embodiment 16: The method of any prior embodiment wherein breaking the frangible element includes introducing a fluid into the control fluid passage at a selected pressure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole component comprising:

a body including a first end portion, a second end portion and an intermediate portion extending therebetween, the intermediate portion including an outer surface and an inner surface, the inner surface defining a flow path;

an axial passage extending radially outwardly of the flow path between the outer surface and the inner surface; and a piston arranged in the axial passage, the piston including a first end, a second end, an intermediate section extending therebetween, the piston including a frangible element arranged adjacent at least one of the first end, the second end, and along the intermediate portion.

2. The downhole component according to claim 1, wherein the piston includes a flow path extending from the first end toward the second end along the intermediate portion.

3. The downhole component according to claim 1, wherein the piston includes a cap member connected at the second end by the frangible element.

4. A downhole system comprising:

a tubular including a tool mechanism having an actuator; and a downhole component mechanically connected to the tubular, the downhole component comprising:

a body including a first end portion, a second end portion and an intermediate portion extending therebetween, the intermediate portion including an outer surface and an inner surface, the inner surface defining a flow path;

an axial passage extending radially outwardly of the flow path between the outer surface and the inner surface; and a piston arranged in the axial passage, the piston including a first end, a second end mechanically connected to the actuator, an intermediate section extending therebetween, the piston including a frangible element arranged adjacent at least one of the first end, the second end, and along the intermediate portion.

5. The downhole system according to claim 4, wherein the piston includes a flow path extending from the first end toward the second end along the intermediate portion.

6. The downhole system according to claim 4, wherein the piston includes a cap member connected at the second end by the frangible element.

7. The downhole system according to claim 6, wherein the cap member is provided at the actuator.

8. The downhole system according to claim 4, wherein the tool mechanism comprises a subsurface safety valve (SSSV).

9. The downhole system according to claim 8, wherein the actuator includes a flow tube that is selectively shiftable through the SSSV.

10. The downhole system according to claim 9, wherein the actuator includes a first support collar connected to the flow tube, and a second support collar connected to the flow tube, the piston being connected to one of the first and second support collars.

11. A method of bypassing a piston in a downhole component comprising:

connecting a tool to a flow tube of a downhole component;

breaking a frangible element that forms part of a piston operatively connected with the flow tube to expose a control fluid passage extending axially through the piston; and flowing a control fluid through the control fluid passage.

12. The method of claim 11, wherein breaking the frangible element includes rotating the flow tube to exert a shear force on the frangible element.

13. The method of claim 11, wherein breaking the frangible element includes axially shifting the flow tube to exert a tensile force on the frangible element.

14. The method of claim 13, wherein axially shifting the flow tube includes shifting a shear member.

15. The method of claim 14, further comprising: limiting axial travel of the flow tube after shearing the shear member.

16. The method of claim 11, wherein breaking the frangible element includes introducing a fluid into the control fluid passage at a selected pressure.

* * * * *